United States Patent [19]

Spitaler

[11] Patent Number: 4,548,424

[45] Date of Patent: Oct. 22, 1985

[54] SAFETY SKI BINDING RELEASE MECHANISM

[75] Inventor: Engelbert Spitaler, Wiener Neudorf, Austria

[73] Assignee: TMC Corporation, Baar, Switzerland

[21] Appl. No.: 541,600

[22] Filed: Oct. 13, 1983

[30] Foreign Application Priority Data

Oct. 19, 1982 [AT] Austria ..... 3836/82

[51] Int. Cl.[4] ..... A63C 9/08

[52] U.S. Cl. ..... 280/612; 280/613

[58] Field of Search ..... 280/611, 612, 613, 625, 280/634

[56] References Cited

U.S. PATENT DOCUMENTS

| | | | |
|---|---|---|---|
| 4,130,296 | 12/1978 | D'Antonio | 280/612 |
| 4,436,321 | 3/1984 | Storandt | 280/612 |
| 4,457,532 | 7/1984 | Knabel | 280/612 |
| 4,460,195 | 7/1984 | Bildner | 280/612 |

FOREIGN PATENT DOCUMENTS

| | | | |
|---|---|---|---|
| 324903 | 7/1973 | Austria | 280/612 |
| 0033131 | 1/1981 | European Pat. Off. | 280/612 |
| 2907939 | 6/1979 | Fed. Rep. of Germany | 280/612 |

*Primary Examiner*—Joseph F. Peters, Jr.
*Assistant Examiner*—Everett G. Diederiks, Jr.
*Attorney, Agent, or Firm*—Flynn, Thiel, Boutell & Tanis

[57] ABSTRACT

A safety ski binding which can releasably hold a ski boot on a ski includes a release mechanism having a slide member which operatively engages the ski boot when it is held in the binding and moves from an initial position in a first direction in response to movement of the ski boot during a release thereof. A coupling mechanically couples the resilient arrangement to the slide member, the resilient arrangement biasing the slide member in a second direction opposite the first direction. The coupling automatically interrupts the coupling of the resilient arrangement and the slide member when the slide member has moved a first distance from its initial position in the first direction. A pickup responsive to movement of the slide member sends signals to a circuit which, when the slide member has moved a second distance less than the first predetermined distance from its initial position, actuates an arrangement which causes the coupling to interrupt the coupling of the slide member and resilient engagement.

6 Claims, 8 Drawing Figures

SAFETY SKI BINDING RELEASE MECHANISM

FIELD OF THE INVENTION

This invention relates to a safety ski binding release mechanism and, more particularly, to a release mechanism which includes at least one sole holder, holding jaw or the like which engages a two-part slide member which is movable against the force of a spring, a coupling device which can couple the slide member parts and is releasable in dependence on the slide member stroke, and a binding part which releases the coupling device, wherein one slide member part carries one abutment for the spring and, after a release of the coupling device, is returned by the urging of the spring into its inital position, and wherein the other abutment for the spring is formed by a preferably ski-fixed housing part of the binding.

BACKGROUND OF THE INVENTION

A release mechanism of this type is disclosed for example in Austrian Pat. No. 368 025 (which corresponds to the U.S. Pat. No. 4,405,152). This release mechanism cooperates with the sole holder levers of a front jaw, which sole holder levers can be swung out laterally. After a certain swinging out movement of one of the two sole holder levers, there occurs a release of the coupling device, and since the slide member is then no longer biased by the spring, a quick and force-free swinging out of the sole holder lever is assured. This release mechanism operates entirely mechanically.

A release mechanism which is controlled by an electronic circuit is part of the binding which is disclosed in German Offenlegungsschrift No. 29 07 939. In this binding, electric signals produced by sensors responsive to forces exerted by a ski boot are processed in an electronic circuit. If the electronic circuit recognizes that the forces acting on the skier have reached a critical value, an electromagnetic device is operated and drives a pinion in such a manner that a rack operates a toggle lever linkage (see in particular FIGS. 1–3). Through this, a nose is freed from a pivot, and hooks which laterally hold the ski boot are also freed. In this manner, a housing is freed for rotation, so that the ski boot can rotate with the housing and can also be released from the housing due to the release of the hooks. However, when the electronic circuit is not working, or when the battery is discharged, a release is not possible in this binding. Furthermore, a relatively high current output from the battery is necessary for the operation of this release mechanism.

A purpose of the invention is therefore to provide a release mechanism of the above-described type which has an electrically controlled release but does not have the disadvantages of the conventional devices. When the electric circuit does not work or a discharge of the power source has occurred, a mechanical release is still to be possible.

SUMMARY OF THE INVENTION

This purpose is attained inventively by providing a release mechanism of the above-mentioned type in which the slide member stroke is detected by a potentiometric motion pickup, signals from which are processed in dependence on their existence and time duration in an electric circuit which, upon the signals exceeding a predetermined value prior to a mechanical release of the coupling device, and preferably through a motor, actuates the binding part which releases the coupling device between the slide member parts.

In this manner, a release of the binding in the case of danger is assured with a small current consumption. Through the time dependency of the measurement, strong but short impacts which are not yet dangerous to the leg of the skier do not result in a release. In a case where the electronic circuit is not working or in a case where the battery is discharged, a proper mechanical release is still assured for safety. Also, use of this release mechanism both in bindings which consist of a front jaw and heel holder and also in bindings with a sole plate and holding jaws which engage, for example laterally, the boot sole is possible.

A further characteristic of the invention involves the binding part which releases the coupling device between the slide member parts being a release sleeve with a rack which has a tooth system which engages a pinion driven by a motor. This construction is structurally very simple and does not require any complex and expensive mechanical changes to the mechanical release mechanism.

BRIEF DESCRIPTION OF THE DRAWINGS

Further characteristics, advantages and details of the invention will now be described in connection with the drawings, which illustrate one exemplary embodiment.

In the drawings.

DETAILED DESCRIPTION

Figure 1:
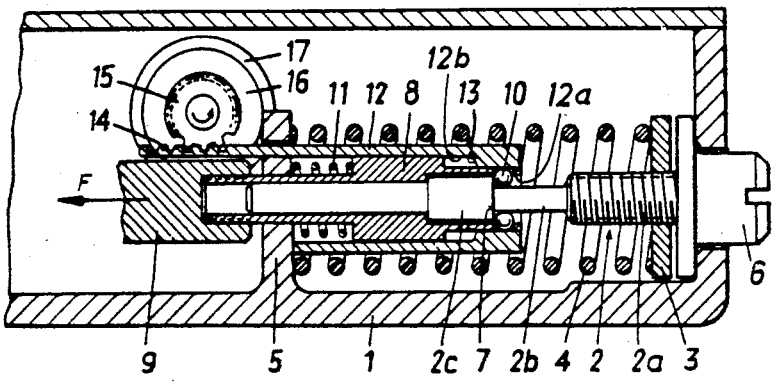
FIG. 1 is a fragmentary cross-sectional side view of a safety ski binding embodying the invention in a downhill skiing position.

As can be seen from the drawings, the inventive release mechanism is provided in a housing 1. The housing 1 may be a ski-fixed structural part, or a structural part which is supported on or in a further binding part. Within the housing 1 there is supported a two-part slide member, one part of which is constructed as a draw rod or pull rod 2. One end of the pull rod 2 is provided with a threaded section 2*a* which threadedly cooperates with an abutment 3 for a spring 4. The other end of the spring 4 is supported on an upright, transversely extending intermediate wall 5 of the housing 1. The end of the pull rod 2 which has the threaded section 2*a* is provided with a screwhead 6, which projects outwardly through the housing 1 and is provided with a slot for receiving an operating tool such as a screwdriver. The initial tension of the spring 4 can therefore be adjusted by rotating the screwhead 6 of the pull rod 2. A middle section 2*b* of the pull rod 2 follows the threaded section 2*a* and transfers, through an annular, axially facing shoulder 7, into a section 2c. The diameter of the section 2c is greater than the diameter of the middle section 2b. The pull rod 2 is surrounded by a cage or sleeve 8 in the region of its middle section 2b and its section 2c, which cage also extends through an opening provided in the wall 5 of the housing 1, whereby the end of the cage 8 remote from the rod 2 carries a thread onto which a second slide member part 9 is screwed. The slide member part 9 is the structural part of the binding to which release forces acting on a ski boot held in the binding are transmitted, for example by sole holder levers of a front jaw which can be swung out in a horizontal plane. The sole holders are conventional and not illustrated, and are preferably similar to those disclosed in U.S. Pat. No. 4,405,152, the disclosure of which is incorporated herein by reference. The slide member 9 can also be a structural part of a binding with a sole plate, which structural part cooperates with holding jaws which engage the boot sole or a sole fitting. Such mechanical arrangements are also know.

The end of the cage 8 which is nearest the middle section 2b of the pull rod 2 has radially extending holes therethrough which receive balls 10. These holes are evenly distributed about the circumference of the cage 8, and at least three holes for balls 10 are provided. The diameter of each ball 10 is slightly smaller than the diameter of its hole, so that it sits with a small clearance in its hole. The radial thickness of the cage 8 in the region of the balls 10 is less than the diameter of the balls 10. The balls 10 are supported, in the downhill skiing position of the safety ski binding, on the shoulder 7 which offsets the middle section 2b of the rod 2 from the section 2c thereof.

The cage 8 is biased by a helical compression spring 11 which encircles the cage 8 and is supported at one end on the cage 8 and at the other end on the partition 5 of the housing 1. The cage 8 is concentrically surrounded by a cylindrical release sleeve 12. An end portion 12a of the release sleeve 12 surrounds the balls 10 and has an inner diameter selected so that the balls 10 of the cage 8 rest on the surface of the section 2b of the rod 2 and on the inner surface of the release sleeve 12. This end portion of the release sleeve 12 extends over a portion of the length of the release sleeve 12 and determines the elasticity range for a release of the binding. Through an annular, axially facing shoulder or edge 13 which is inclined at all points around the circumference of the release sleeve 12, a transition is defined to a portion 12b of the release sleeve 12 which has a larger inside diameter than the end portion 12a. The release sleeve 12 has an axial extension or rack 14 thereon which extends through an opening in the wall 5 of the housing 1 and, in the present exemplary embodiment, is arranged above and parallel to the slide member part 9. The rack 14 is provided with a tooth system which extends longitudinally thereof and engages teeth of a pinion 15. The pinion 15 is coupled by a gearing mechanism 16 to an electric motor 17, which in turn is electrically connected to an electronic circuit 18. The motor 17 could be, for example, a "MICRO T05" and the gearing mechanism 16 the "MICRO T05 485:1" manufactured by GRAUPNER, D 7312 Kirchheim-Teck, West Germany. A potentiometric pickup 19 is secured on the slide member 9 and produces a signal which is processed in the electronic circuit 18.

The pickup 19 includes a housing 19a which is secured to the slide member 9 and a plunger 19b which is movably supported in the housing 19a and is biased into engagement with the wall 5 by a not illustrated spring. The position of the plunger 19b relative to the housing 19a thus always corresponds to the position of the slide member 9 relative to the housing 1. The pickup 19 also includes in the housing 19a a potentiometer 19c (FIG. 1a), the wiper of which is controlled by the plunger 19b. The pickup 19 thus serves as a variable resistor, the resistance of which varies with the position of the slide member 9 relative to the housing 1. The pickup 19 could be, for example, a potentiometer "QXYZZ 2322 43 P", manufactured by PHILIPS NEDERLAND, 5600PB Eindhoven.

Figure 1A:
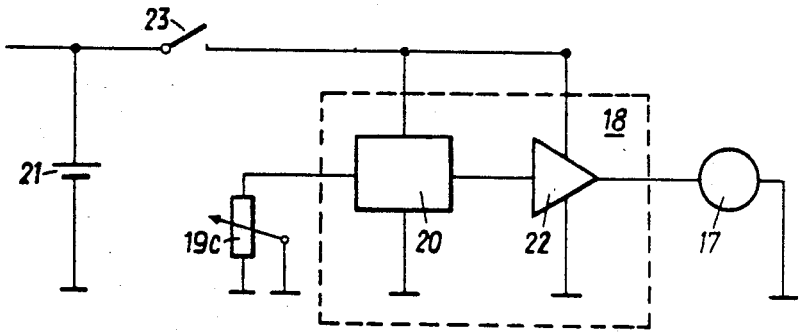
FIG. 1*a* is a block diagram of an electronic circuit which is part of the binding of FIG. 1.

FIG. 1a illustrates the electronic circuit 18 in a block diagram. The supply of power for the electronic circuit 18 is provided by a battery or other voltage source 21 which is disposed in the housing 1. When a ski boot steps into the binding, it closes a switch 23 which creates an electrically conducting connection from the voltage source 21 to the electronic circuit 18. The electronic circuit 18 includes an evaluating circuit 20 and a motor control circuit 22 for controlling the motor 17.

Figure 2:
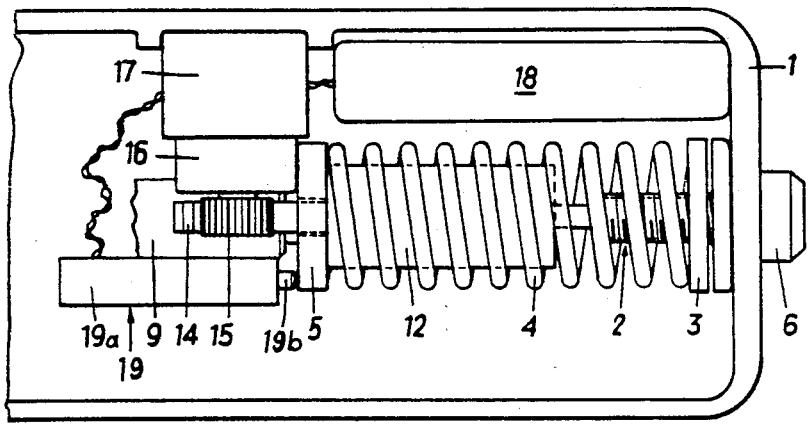
FIG. 2 is a fragmentary top view of the binding of FIG. 1 with a cover plate removed.
Figure 5:
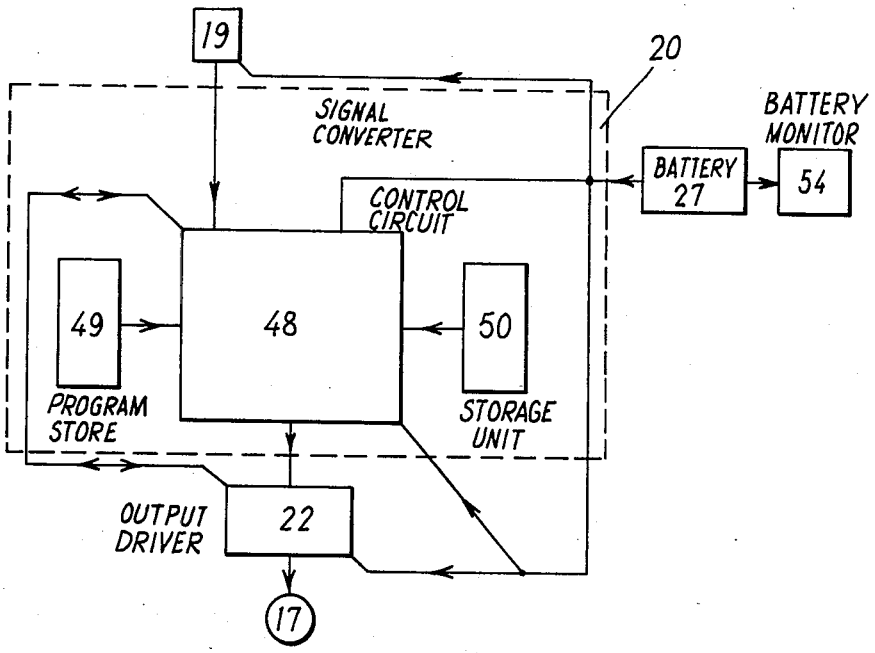
FIG. 5 is a block diagram for a control unit for controlling the inventive binding.

FIG. 5 is a block diagram of an exemplary control unit 20 for use with the inventive release mechanism of FIGS. 1 to 4. For convenience, the description which follows describes the evaluation circuit 20 in connection with the release mechanism of FIG. 1. The force sensing element, for example the potentiometric motion pickup 19 (FIG. 2), is connected to a signal converter 46, which in turn is connected to the battery 21 and the central control circuit 48. The control circuit 48 is also connected to an exchangeable program store 49, a storage unit 50 for user-specific data, and a motor control circuit 22 which drives the motor 17 (FIG. 2).

Figure 6:
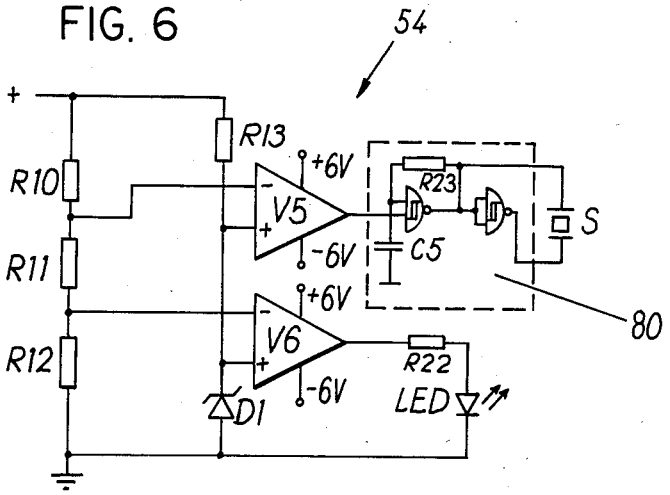
FIGS. 6 and 7 are schematic diagrams of exemplary circuits implementing different parts of the control unit of FIG. 5.
Figure 7:
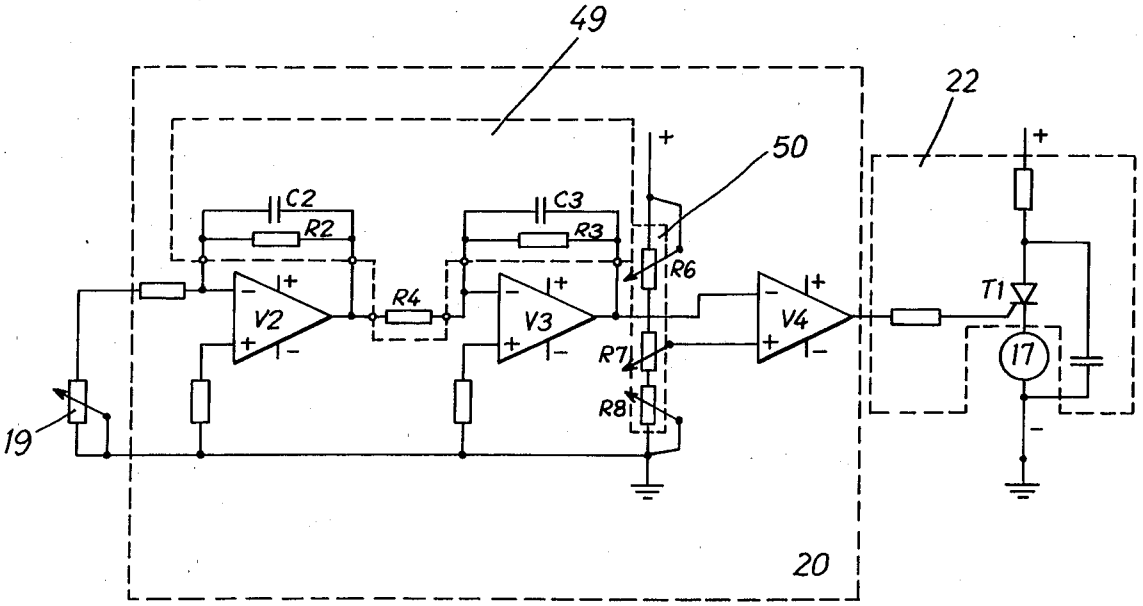

FIGS. 6 and 7 schematically illustrate an exemplary circuit for the evaluation circuit 20. The signal entering the control circuit 48 from the potentiometric pickup 19 is fed to the integrator V2. The R-C network comprising resistor R2 and capacitor C2 defines the feedback path of integrator V2, and the output resistor R4 of the integrator V2 is connected to the summing amplifier V3. The amplifier V3 has also an R-C network $R_3$, $C_3$ in its feedback path. The R-C networks $R_3$, $R_2$, $C_3$, $C_2$ could be changed with networks with other R and/or C values and therefore they correspond to the ability group of the particular skier, for example a beginning or sport skier, the signal amplification and dynamic release behavior being predetermined by the particular component values selected so as to correspond to the appropriate ability group. The program store 49 could, for example, be located in a not shown slide in the binding. The output signal of V3 is then fed to the amplifier V4, which acts as a threshold switch, the switching threshold of which is determined by the voltage divider comprising variable resistors R6, R7 and R8, which resistors are provided in the storage unit 50 and have values corresponding to user-specific data.

The motor control circuit 22 which is driven by the threshold switch, namely, amplifier V4, is formed substantially by a thyristor T1 which is connected to and controls the motor 17.

FIG. 6 illustrates an exemplary embodiment of a battery monitor 54 which includes two threshold switches formed by operational amplifiers V5 and V6, each having an input connected to a different point in a voltage divider comprising three resistors R10, R11 and R12 which are connected in series across the battery. The other inputs of the amplifiers V5 and V6 receive a common reference voltage generated by the series connection of zener diode D1 and resistor R13 across the battery. A light emitting diode (LED) is connected through a resistor to the output of the operational amplifier V6 and lights up when the battery output drops below a certain predetermined voltage value and causes amplifier V6 to switch state, thereby indicating that the battery must be either charged or exchanged. If the battery output voltage applied at the + and − terminals drops further, then the operational amplifier V5 also changes its switching condition and causes the oscillator 80 to oscillate, driving the piezo summer S connected thereto so that it emits an audible signal to indicate that the jaw or jaws can no longer be safely used. All parts of these circuits are commercially available parts and a man skilled in the art is able to obtain and interconnect them.

Figure 3:
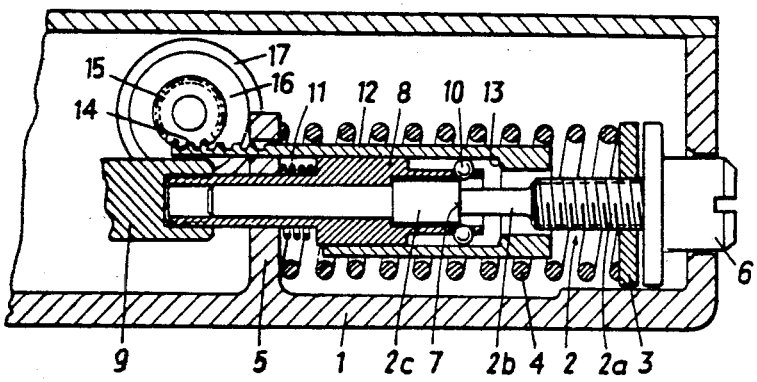
FIG. 3 is a fragmentary sectional side view similar to FIG. 1 which shows the release mechanism of the binding at the point in time at which a release occurs.
Figure 4:
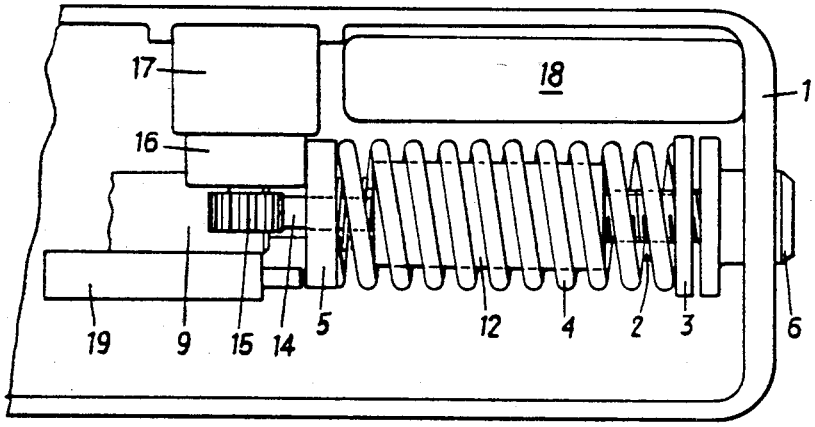
FIG. 4 is a fragmentary top view similar to FIG. 2 which shows the release mechanism of the binding at the point in time at which a release occurs.

The release mechanism operates as follows. When a force acts onto the slide member part 9 in the direction of the arrow F in FIG. 1 and is greater than the adjusted force of the spring 4, the slide member part 9 moves, together with the cage 8, in the direction of the arrow F in FIG. 1. Since the balls 10 are held against the shoulder 7 of the pull rod 2, the pull rod 2 moves axially with the cage 8 and the slide member part 9, which causes the spring 4 and the spring 11 to be compressed. The release sleeve 12 engages the wall 5 and thus remains stationary. The movement of the slide member part 9 effects a change in the resistance of the potentiometric motion pickup 19. As soon as the slide member part 9 has moved a distance which is slightly less than the initial distance of the balls 10 from the shoulder 13 of the release sleeve 12, the evaluating circuit 20, which processes the signals from the potentiometric pickup 19, emits a release signal to the circuit 22 to cause it to actuate the motor 17. The motor 17 drives the pinion 15 through the gearing mechanism 16, which pinion engages the teeth on the rack 14 of the release sleeve 12. Through this, the release sleeve 12 is moved in the direction of the balls 10, or in other words rightwardly in FIG. 1, so that the balls 10 pass the shoulder 13 of the release sleeve 12 and can move radially outwardly to positions free of engagement with the shoulder 7 of the pull rod 2. As soon as this position, illustrated in FIG. 3, is reached, the pull rod 2 is returned to its initial position under the urging of the spring 4, and the spring 4 relaxes to its original tension. The slide member part 9 is now no longer biased by the spring 4, and so an almost force-free release of the ski boot can occur at the sole holders, which are coupled to the slide member part 9.

The evaluating circuit 20 produces the release control signal in dependence on both the distance which the slide member part 9 has moved and the time interval within which this movement occurred. In this manner, it is assured that strong but relatively short impacts, which are not dangerous to the leg of the skier, do not result in a release.

For the return of the release mechanism into its initial position, the spring 11 returns the cage 8 into its initial position and a reverse rotation of the motor 17 is effected. The reverse rotation of the motor 17 can be controlled by the electronic circuit 18, which for example after a predetermined time interval of several seconds following a release of the pull rod 2 can effect a reverse rotation of the motor 17.

If the voltage source 21 becomes too weak, and proper functioning of the electronic circuit 18 is no longer assured, then the inventive release mechanism can still free the ski boot in a purely mechanical manner. In particular, as soon as the movement of the slide member part 9 is sufficiently large, the balls 10 reach the edge 13 of the release sleeve and move out of engagement with the shoulder 7 of the pull rod 2. The pull rod 2 can then return to its initial position under the urging of the release spring 4, since the slide member part 9 is no longer biased by the spring 4. Since the mechanical release requires only a slightly greater movement of the slide member part 9 than an electrical release, even in this case a safety release is assured and injuries to the skier are prevented.

A further advantage of this release mechanism is that an elasticity range which is as large as desired and which is freely adjustable is available.

The invention is not limited to the illustrated exemplary embodiment. Further modifications and variations, including the rearrangement of parts, are conceivable without leaving the scope of protection. Thus, the inventive release mechanism can be used for a binding system which includes a front jaw and a heel holder, and also for a safety ski binding which includes a sole plate and a holding jaw which engages, for example laterally, a boot sole. Furthermore, it is conceivable to use the invention with other mechanical release mechanisms, as long as they have a structural part which is movable against the force of a spring and preferably can support the potentiometric motion pickup.

The embodiments of the invention in which an exclusive property or privilege is claimed are defined as follows:

1. A safety ski binding having a release mechanism which comprises at least one sole holder which engages a two-part slide member supported for movement against the force of a spring, coupling means for releasably coupling the slide member parts to each other and releasable in dependence on movement of the slide member, and a binding part movable to a position in which it effects a release of the coupling means, wherein one slide member part carries one abutment for the spring and, after the release of the coupling means, is returned to an initial position under the urging of the spring, wherein a further abutment for the spring is formed by a housing part of the binding, and wherein the amount of movement of the slide member is sensed by a potentiometric motion pickup which produces electrical signals which are processed in dependence on their time duration in an electronic circuit and, upon exceeding a predetermined limit value prior to a mechanical release of the coupling means, cause the circuit to actuate drive means for effecting movement of the binding part which releases the coupling means.

2. The binding according to claim 1, wherein the drive means includes a motor, and wherein the binding part which releases the coupling means is a release sleeve having a rack thereon, the rack including a tooth system engaged by a pinion driven by the motor.

3. A safety ski binding having a release mechanism which comprises at least one sole holder which is arranged on a housing adapted to be secured on the upper side of a ski and which is cooperable with a two-part slide member supported for movement against the force of a spring, wherein one slide member part carries a movable abutment for the spring, wherein a further abutment for the spring is supported on a part of the housing, wherein a force applied to the sole holder is transmitted through the two-part slide member onto the spring, wherein the slide member parts are releasably coupled by a lock mechanism which, when the slide member exceeds a predetermined amount of movement, can be released mechanically and can be released by an arrangement which includes an electronic circuit, the circuit reacting to signals produced by a sensor system and effecting a release sooner than in a purely mechanical release, the lock mechanism being releasable in dependence on characteristics of the slide member movement, and wherein the sensor system includes a potentiometric motion pickup which is responsive to movement of the slide member and produces electrical signals which are dependent on the time duration of the slide member movement and are processed in the electronic circuit.

4. The binding according to claim 3, wherein the circuit drives a motor which in turn moves a binding part which releases the lock mechanism coupling the slide member parts.

5. The binding according to claim 4, wherein the binding part which releases the lock mechanism is a release sleeve with a rack which includes a tooth system, the tooth system engaging a pinion driven by the motor, wherein the lock mechanism includes plural balls, and wherein the release sleeve has an inner surface portion which is inclined and can engage the balls of the lock mechanism.

6. A safety ski binding adapted to releasably hold a ski boot on a ski and having a release mechanism which comprises a movably supported member which is operatively coupled to the ski boot when the ski boot is releasably held in said binding and is movable away from an initial position in a first direction in response to movement of the ski boot during a release thereof from said binding; resilient means, and mechanical coupling means for releasably operatively coupling said resilient means and said member, said resilient means biasing said member in a second direction opposite said first direction and said coupling means being adapted to interrupt said releasable coupling of said member and said resilient means when said member has moved a first distance from said initial position in said first direction; pickup means responsive to said member for producing an electrical signal which indicates the position of said member; circuit means responsive to said pickup means for evaluating said electrical signal and for producing a release signal when said means has moved a second distance less than said first distance from said initial position; and means responsive to said circuit means and cooperable with said coupling means for interrupting said releasable coupling of said member and said resilient means in response to the presence of said release signal.

* * * * *